US008256146B2

(12) United States Patent
Loverin

(10) Patent No.: US 8,256,146 B2
(45) Date of Patent: Sep. 4, 2012

(54) INFANT SHOES

(75) Inventor: Marc R. Loverin, Scituate, MA (US)

(73) Assignee: The Stride Rite Corporation, Lexington, MA (US)

( * ) Notice: Subject to any disclaimer, the term of this patent is extended or adjusted under 35 U.S.C. 154(b) by 852 days.

(21) Appl. No.: 12/112,510

(22) Filed: Apr. 30, 2008

(65) Prior Publication Data

US 2009/0272010 A1 Nov. 5, 2009

(51) Int. Cl.

| | |
|---|---|
| ***A43C 15/00*** | (2006.01) |
| ***A43B 1/10*** | (2006.01) |
| ***A43B 13/00*** | (2006.01) |
| ***A43B 3/28*** | (2006.01) |

(52) U.S. Cl. ..... 36/102; 36/103; 36/112; 36/59 C; D2/954

(58) Field of Classification Search ..... 36/59 C, 36/25 R, 112, 88, 90, 103, 105, 102, 138; D2/900, 953–957

See application file for complete search history.

(56) References Cited

U.S. PATENT DOCUMENTS

| | | | | | |
|---|---|---|---|---|---|
| 1,123,245 | A | * | 1/1915 | Chesbrough | 36/19 A |
| 2,278,626 | A | * | 4/1942 | Vasko | 36/81 |
| 2,619,744 | A | | 12/1952 | Mattes | |
| 2,677,903 | A | | 5/1954 | Gaquin | |
| 3,075,305 | A | * | 1/1963 | Shapiro et al. | 36/112 |
| 3,142,911 | A | | 8/1964 | Waters | |
| D204,053 | S | * | 3/1966 | Mason et al. | D2/900 |
| 3,349,505 | A | | 10/1967 | Lopez | |
| 3,500,561 | A | | 3/1970 | Epstein | |
| 3,681,860 | A | | 8/1972 | Bidegain | |
| 3,728,803 | A | | 4/1973 | Hirasawa et al. | |
| 3,824,716 | A | * | 7/1974 | Di Paolo | 36/32 R |
| 3,885,328 | A | * | 5/1975 | Hirasawa | 36/112 |
| D281,641 | S | * | 12/1985 | Shiki | D2/953 |
| D293,503 | S | * | 1/1988 | Mitsui et al. | D2/953 |
| 4,727,660 | A | * | 3/1988 | Bernhard | 36/88 |
| 4,757,620 | A | | 7/1988 | Tiitola | |
| 5,052,130 | A | * | 10/1991 | Barry et al. | 36/107 |
| 5,090,140 | A | * | 2/1992 | Sessa | 36/138 |
| 5,392,535 | A | * | 2/1995 | Van Noy et al. | 36/88 |
| 5,761,834 | A | * | 6/1998 | Grim et al. | 36/88 |
| D432,292 | S | * | 10/2000 | Kim | D2/902 |
| 6,189,239 | B1 | | 2/2001 | Gasparovic et al. | |
| 6,405,458 | B1 | | 6/2002 | Fleshman | |
| 6,457,976 | B1 | | 10/2002 | Fleshman | |
| 6,516,541 | B2 | | 2/2003 | Cagner | |

(Continued)

FOREIGN PATENT DOCUMENTS

| | | |
|---|---|---|
| DE | 20100820 | 10/2001 |

(Continued)

OTHER PUBLICATIONS

Invitation to Pay Additional Fees; PCT/US2009/039854; mailed Oct. 7, 2011.

*Primary Examiner* — Khoa Huynh
*Assistant Examiner* — Melissa Lalli
(74) *Attorney, Agent, or Firm* — Fish & Richardson P.C.

(57) ABSTRACT

An infant shoe includes a shoe outsole defining a longitudinal axis and a transverse axis. The outsole defines a substantially arcuate shape along both the longitudinal and transverse axes. A shoe upper is secured to the shoe outsole. The shoe upper and the shoe outsole together define curved side surfaces.

9 Claims, 7 Drawing Sheets

U.S. PATENT DOCUMENTS

| | | | | |
|---|---|---|---|---|
| 6,578,291 | B2 | 6/2003 | Hirsch et al. | |
| 6,665,961 | B2 * | 12/2003 | Kobayashi et al. | 36/127 |
| 6,748,673 | B2 * | 6/2004 | Coplon et al. | 36/8.4 |
| 6,782,639 | B1 | 8/2004 | Muller | |
| 6,810,606 | B1 | 11/2004 | Ellis, III | |
| 6,836,978 | B1 | 1/2005 | Lauer et al. | |
| D504,555 | S * | 5/2005 | Urie | D2/955 |
| 7,225,564 | B1 | 6/2007 | Gillespie | |
| D547,933 | S * | 8/2007 | Loverin | D2/955 |
| D581,641 | S * | 12/2008 | Bethke, Jr. | D2/957 |
| 7,513,064 | B2 * | 4/2009 | Fuerst | 36/11.5 |
| 7,743,531 | B2 * | 6/2010 | Aveni et al. | 36/105 |
| 2002/0073580 | A1 | 6/2002 | Fleshman | |
| 2002/0157279 | A1 | 10/2002 | Matsuura et al. | |
| 2003/0182820 | A1 * | 10/2003 | Fuerst et al. | 36/11.5 |
| 2004/0148804 | A1 | 8/2004 | Romano et al. | |
| 2007/0294919 | A1 | 12/2007 | Evans | |

FOREIGN PATENT DOCUMENTS

| | | |
|---|---|---|
| EP | 2022359 | 2/2009 |
| JP | 2007 296081 | 11/2007 |

* cited by examiner

INFANT SHOES

TECHNICAL FIELD

This disclosure relates to infant shoes.

BACKGROUND

Generally, infant shoes include an upper portion and a sole. When the upper portion is secured to the sole, the upper portion along with the sole define a void that is configured to securely and comfortably receive and hold an infant's foot. Often, the upper portion and/or sole are/is formed from multiple layers that can be stitched or adhesively bonded together. For example, the upper portion can be made of a combination of leather and fabric, or foam and fabric, and the sole can be formed from at least one layer of rubber. Often materials are chosen for functional reasons, e.g., water-resistance, durability, abrasion-resistance, and breathability, while shape, texture, and color are used to promote the aesthetic qualities of the infant shoe.

SUMMARY

In one aspect, an infant shoe includes a shoe outsole defining a longitudinal axis and a transverse axis. The outsole defines a substantially arcuate shape along both the longitudinal and transverse axes. A shoe upper is secured to the shoe outsole. The shoe upper and the shoe outsole together define curved side surfaces, e.g., rather than right or other sharply angled surfaces as generally found in infant shoes of other design and constructions.

Implementations of the disclosure may include one or more of the following features. In some implementations, the shoe upper has a top-line defining a foot access opening that extends between a toe cap portion of the shoe upper and a heel portion of the shoe upper. A front edge of a forward portion of the foot access opening defines a substantially curved shape.

In some examples, the infant shoe includes a strap having first and second ends and positioned to extend across the foot access opening. The first end of the strap is secured to a first lateral side of the shoe upper. The strap extends across the foot access opening for securing an infant's foot in the infant shoe. The second end of the strap is releasably secured to a second, opposite lateral side of the shoe upper by a strap holder or releasable fasteners (e.g. hook-and-loop type fasteners).

The infant shoe may include a heel tab secured to, or extending from, an upper edge of a heel potion of the shoe upper. The heel tab is configured to move (snap or flip) between a first position for use and a second position for storage. The heel tab extends upwardly and away from the shoe upper while in its first position, and rests substantially against an outer surface of the heel portion of the shoe upper while in its second position.

In some implementations, the shoe outsole includes an outer member having an inner heel region, and an inner member located in the inner heel region. The inner member has a ground-contacting surface and is positioned and dimensioned to fit under a baby's heel during use of the infant shoe. The inner member has a relatively higher durometer than the outer member. The shoe outsole has a forefoot region and an opposite heel region. A bottom surface of the shoe outsole defines a plurality of nested elliptical grooves substantially in the forefoot region. The bottom surface of the shoe outsole also defines a plurality of nested substantially circular grooves substantially in the heel region. At least some of the elliptical grooves intersect at least some of the substantially circular grooves. In some examples, the bottom surface of the shoe outsole defines a plurality of substantially parallel curved grooves in the forefoot region. Each of the curved grooves intersect at least one of the elliptical grooves. The curved grooves are substantially transverse to the longitudinal axis of the shoe outsole and may extend to both lateral side edges of the shoe outsole.

The shoe upper can be stitched to the shoe outsole (versus or in addition to being adhered by cement), providing a substantially seamless transition between the shoe upper and the shoe outsole. The infant shoe includes a foot bed disposed on the shoe outsole inside the infant shoe. The foot bed is compliant to conform to and exhibit the substantially arcuate shape of the shoe outsole, thereby forming a cradle for a foot during use of the infant shoe.

The details of one or more implementations of the disclosure are set forth in the accompanying drawings and the description below. Other features, objects, and advantages will be apparent from the description and drawings, and from the claims.

Like reference symbols in the various drawings indicate like elements. By way of example only, all of the drawings are directed to an infant shoe suitable to be worn on the infant's left foot. The invention includes also the mirror images of the drawings, i.e. an infant shoe suitable to be worn on the infant's right foot.

DETAILED DESCRIPTION

Infants (e.g. babies) have substantially rounded feet, unlike adolescents and adults whom have relatively elongated feet with pronounced substantially flat bottom surfaces. As a result, an infant shoe configured to cradle an infant's foot and mimic the infant foot shape is advantageous, both for comfort and for fit. Typical infant shoes have substantially flat outsoles that form sharp, i.e. right or acute angles with an attached shoe upper. The resulting edges tend to create catch points that can lead to tripping an infant learning to walk.

Figure 1:
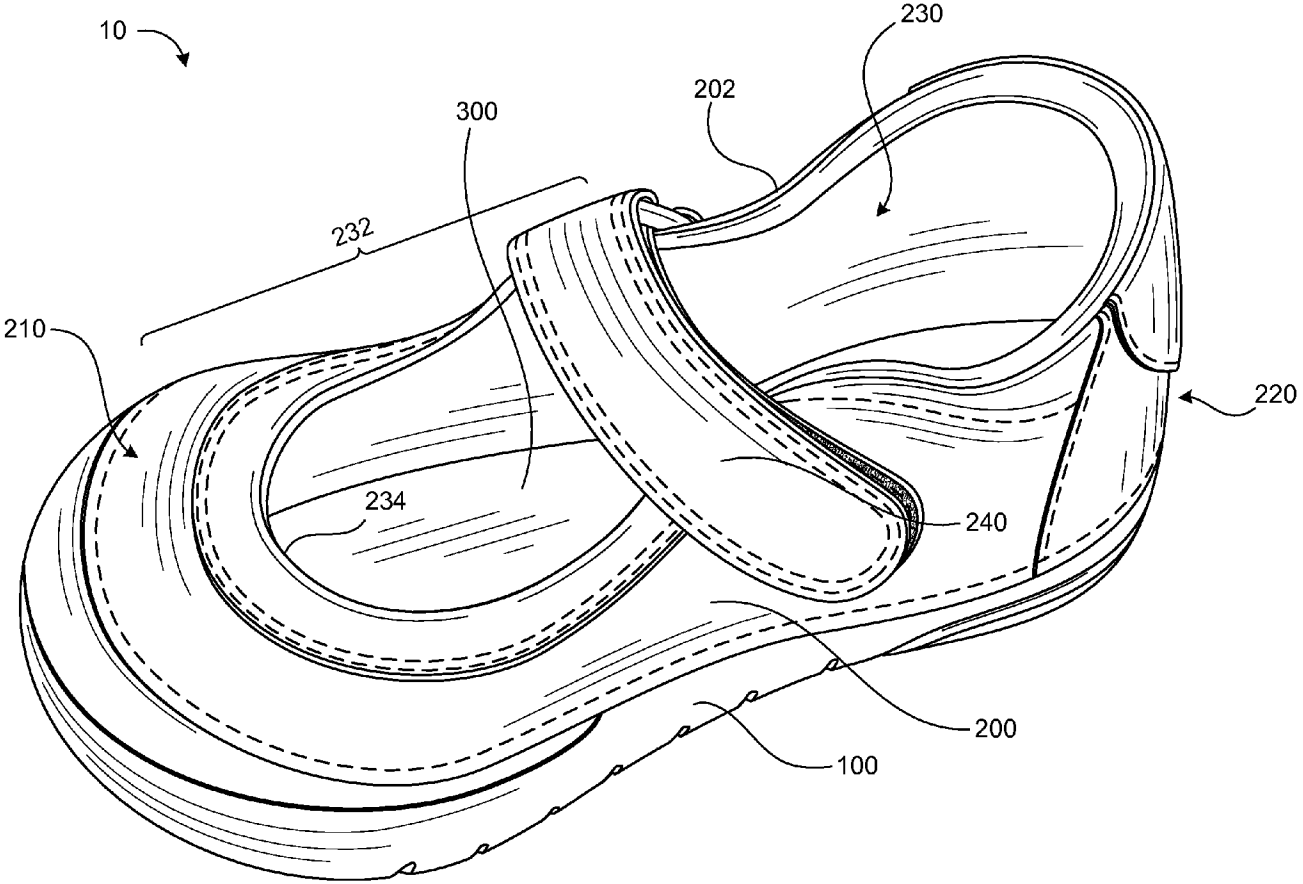
FIG. 1 is an elevated perspective view of an infant shoe.

Referring to FIG. 1, an infant shoe 10 includes a shoe outsole 100 and a shoe upper 200 secured to the shoe outsole 10. The shoe outsole 10 defines a longitudinal axis 102 and a transverse axis 104 (see FIGS. 6-7). The shoe outsole 100 defines a substantially arcuate shape along both the longitudinal and transverse axes 102, 104. The shoe outsole 100 and the shoe upper 200 together define a substantially ellipsoid shape with curves side surfaces. The arcuately shaped shoe outsole 100 has substantially no flat surfaces and mimics the shape of the bottom of an infant's foot (e.g. curved with substantially no flat portions). The shoe outsole 100 and the shoe upper 200 together form no right angles or edges. Unlike conventional shoes which form sharp, e.g., substantially right, angles between a bottom and side surfaces of the shoe, the infant shoe 10 featured in this disclosure defines curved surfaces with no hard bottom edges or sharp angles. An infant learning to walk, particularly of ages 6-18 months old, tends to roll each foot off a supporting surface. When the infant rolls or alters the pitch of one foot on the supporting surface as part of learning to walk, a shoe with angled bottom edge will cause the foot to teeter, thereby causing imbalance or tripping to occur. In contrast, the shoe outsole 100 of the infant shoe 10, featured in this disclose, defines a substantially arcuate shape that allows an infant to roll each foot to either side or forward and backward without rolling over an edge that causes teetering. As a result, the infant can rock its feet without catching or teetering on a bottom edge, thereby maintaining stable contact with the supporting surface.

In some implementations, the shoe upper 200 has a top-line 202 defining a foot access opening 230 that extends between a toe cap portion 210 of the shoe upper 200 and a heel portion 220 of the shoe upper 200. A front edge 234 of a forward portion 232 of the foot access opening 230 defines a substantially curved shape.

Figure 2:
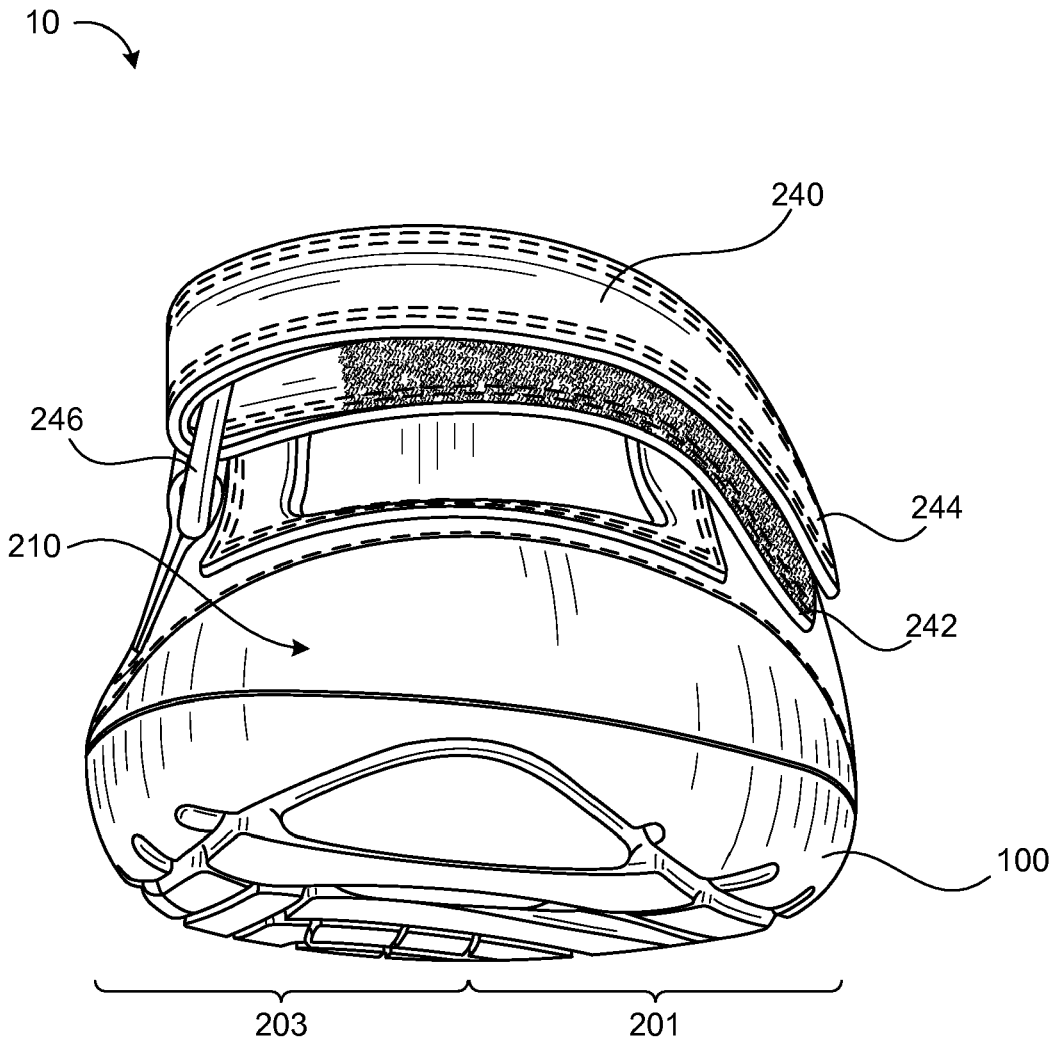
FIG. 2 is a front view of the infant shoe of FIG. 1.
Figure 5:
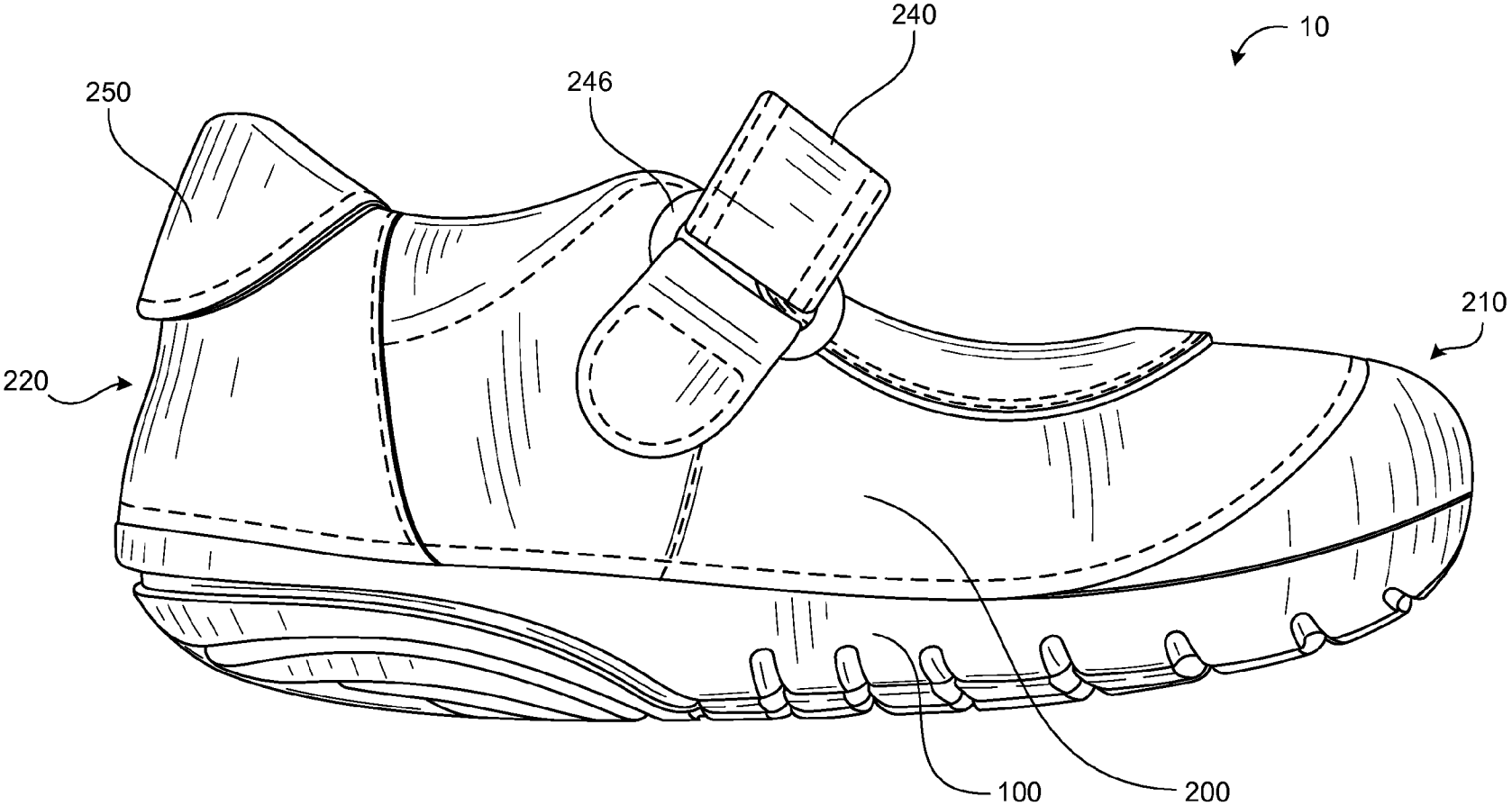
FIG. 5 is a right side view of the infant shoe of FIG. 1.
Figure 6:
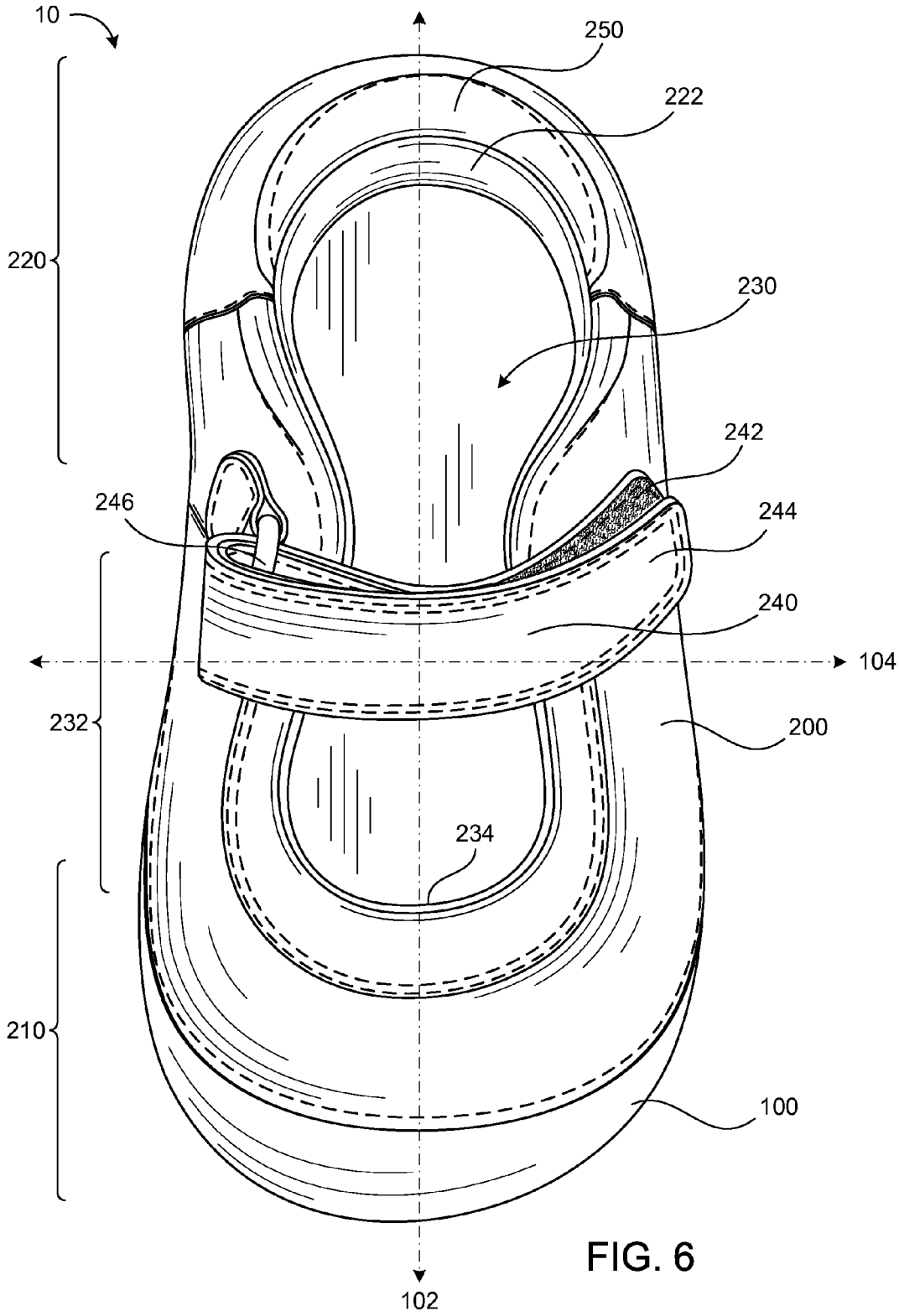
FIG. 6 is a top plan view of the infant shoe of FIG. 1.

Referring to FIGS. 2 and 5-6, in some implementations, the infant shoe 10 includes a strap 240 having first and second ends 242, 244. The strap 240 is positioned to extend across the foot access opening 230. The first end 242 of the strap 240 is secured to a first lateral side 201 of the shoe upper 200, and the second end 242 of the strap 240 is releasably secured to the same side 201 or a second, opposite lateral side 203 of the shoe upper 200. The second end 242 of the strap 240 can be releasably secured by hook-and-loop type fasteners, one or more snaps, a buckle, a magnetic connection, or any other suitable means of releasable attachment. In the example shown, the first end 242 of the strap 240 is secured to the first lateral side 201 of the shoe upper 200 and extends across to the second lateral side 203 of the shoe upper 200 to loop through a strap holder 246 secured to the shoe upper 200. A user can pull the strap 240 tight across an infant's foot placed in the shoe 10, and then secure the second end 244 of the strap 240 to first lateral side 201 of the shoe upper 200 or to the first end 242 of the strap 240, as shown. In other examples, the infant shoe 10 includes a z-strap or eyelets with laces for securing an infant's foot in the infant shoe 10. A z-strap operates in the same manner as the strap 240 described above, except that the strap 240 extends diagonally across the longitudinal axis 102 between the two lateral sides 210, 203 and may loop through a strap holder 246 to form a zig-zag pattern.

Figure 3:
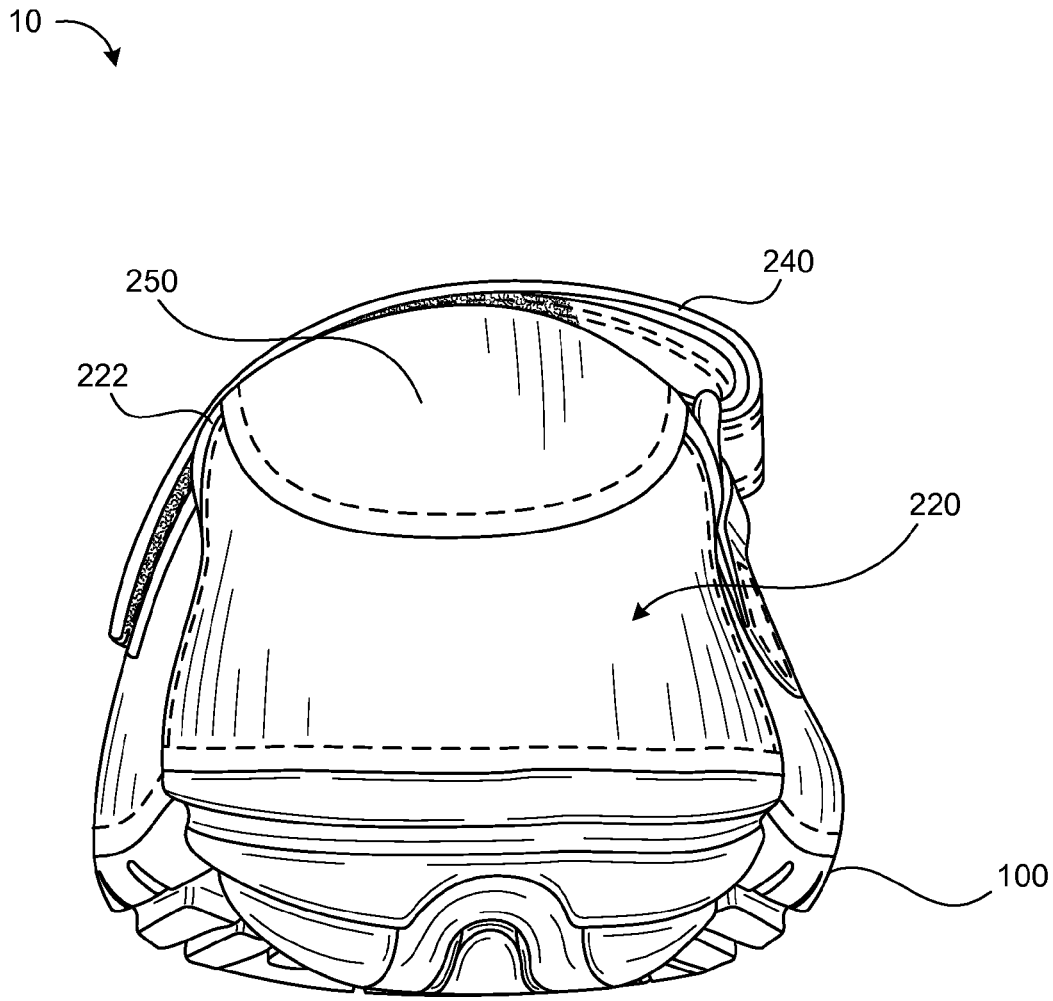
FIG. 3 is a rear view of the infant shoe of FIG. 1.
Figure 4:
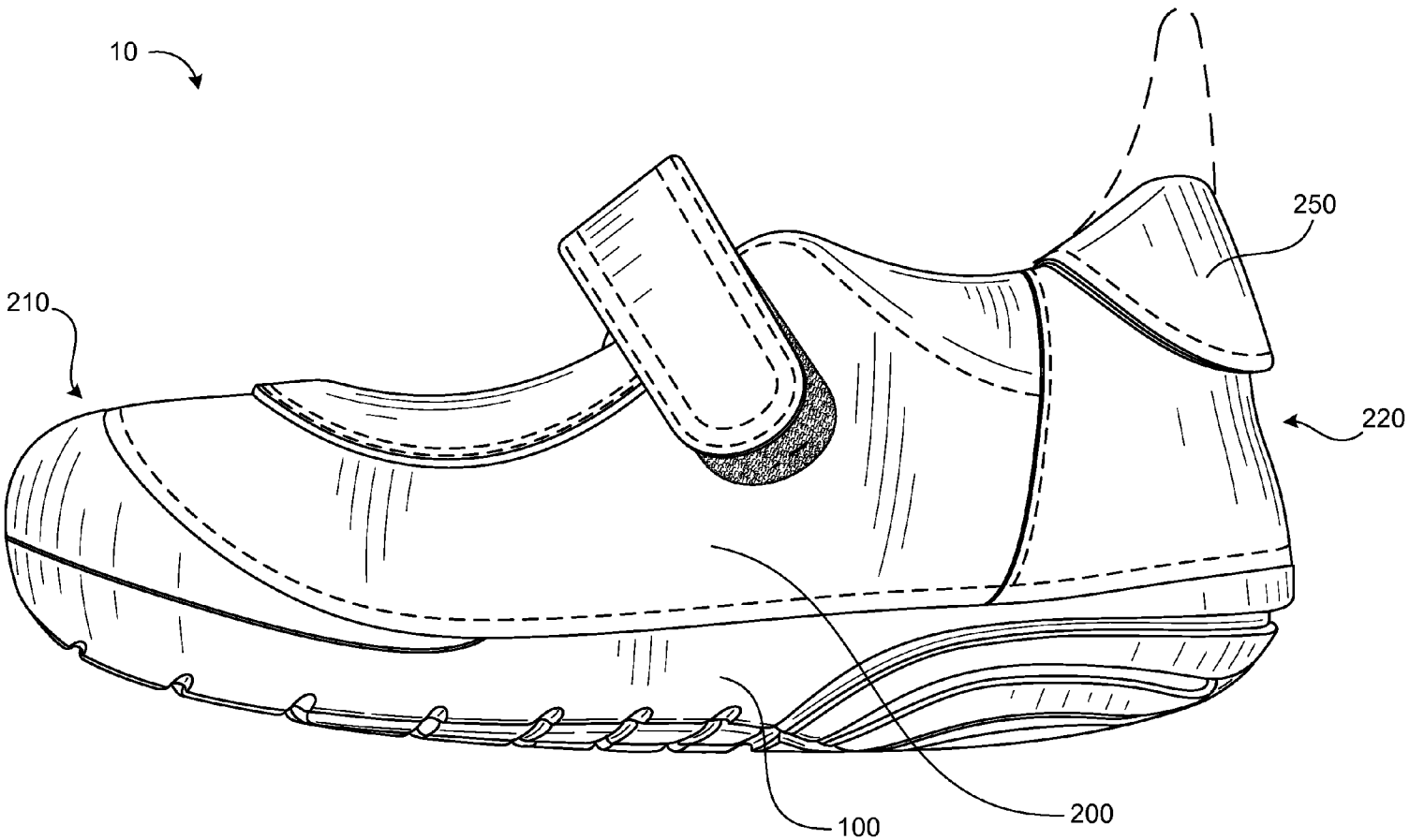
FIG. 4 is a left side view of the infant shoe of FIG. 1.

Referring to FIGS. 3-4, in some implementations, the infant shoe 10 includes a heel tab 250 secured to or extending from an upper edge 222 of the heel potion 220 of the shoe upper 200. The heel tab 250 is configured to flip up to a first position for use and flip down to a second position, as shown, for storage. The heel tab 250 extends upwardly and away from the shoe upper 200 while in its first position. The heel tab 250 rests substantially against the heel portion 220 while in its second position. The heel tab 250 is configured to aid donning the infant shoe 10. A user moves the heel tab 250 from the second position to the first position for use. The heel tab 250 may act to guide an infant's foot, and in particular the infant's heel, into the foot access opening 230. The heel tab 250 can be grasped by a user to pull the shoe 10 onto an infant's foot.

Figure 7:
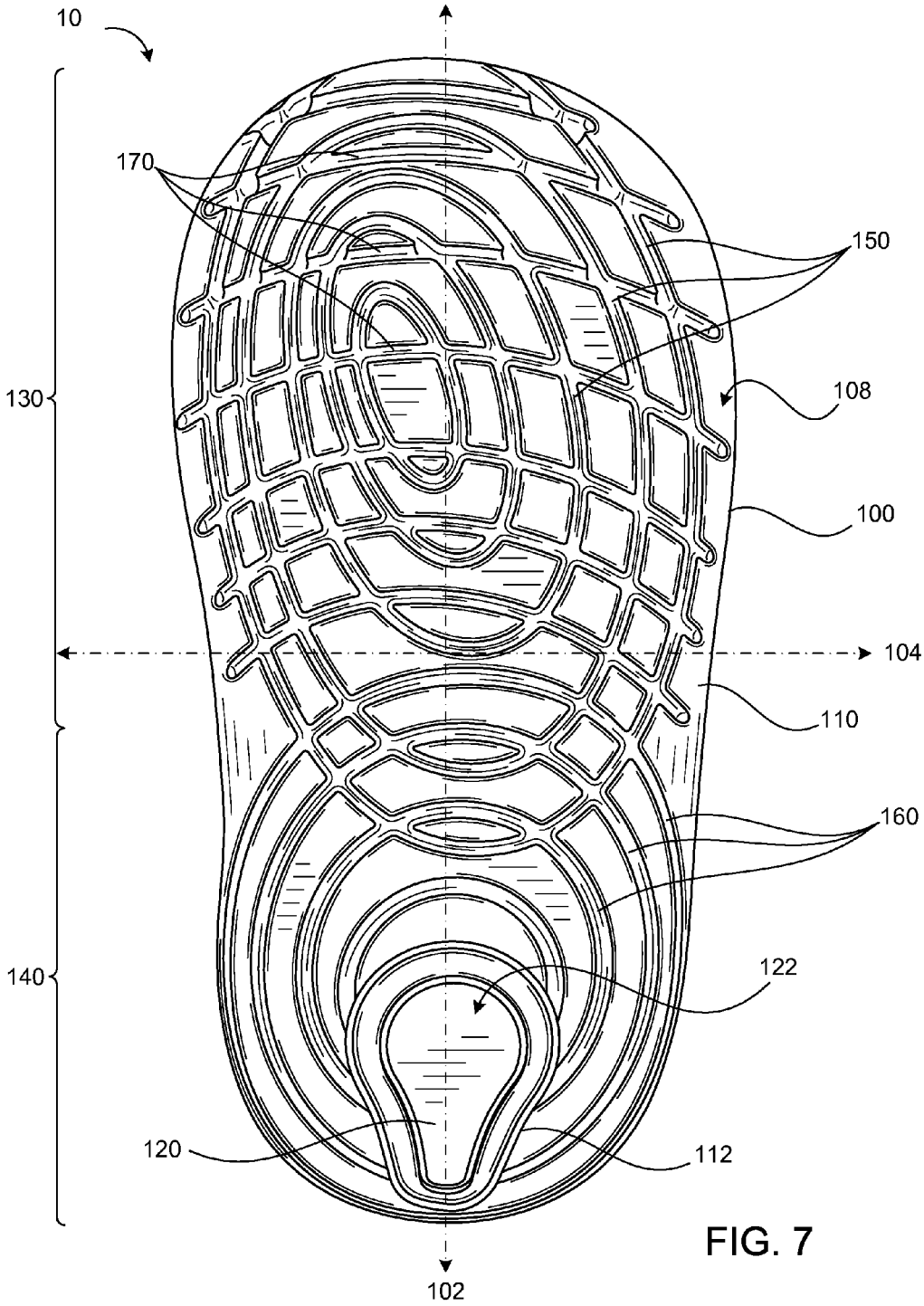
FIG. 7 is a bottom plan view of the infant shoe of FIG. 1.

In the example illustrated in FIG. 7, the shoe outsole 100 includes an outer member 110, having an inner heel region 112, and an inner member 120 located in the inner heel region 112. The inner member 120 has a ground contacting surface 122 and a relatively higher durometer than the outer member 110. The outer member 110 may have a durometer of between about 45 Shore A and about 55 Shore A (preferably 50 Shore A). The inner member 120 may have a durometer of between about 55 Shore A and about 60 Shore A (preferably 55 Shore A). The inner member 120 is positioned and dimensioned to fit under a baby's heel during use of the infant shoe 100.

In some implementations, the shoe outsole 100 has a forefoot region 130 and an opposite heel region 140. A bottom surface 108 of the shoe outsole 100 defines a plurality of nested elliptical grooves 150 substantially in the forefoot region 130 and a plurality of nested substantially circular grooves 160 substantially in the heel region 140. At least some of the elliptical grooves 150 intersect at least some the substantially circular grooves 160. The bottom surface 108 of the shoe outsole 100 defines a plurality of substantially parallel curved grooves 170 in the forefoot region 130. Each of the curved grooves 170 intersect at least one of the elliptical grooves 150. The grooves 150, 160, 170 provide flexibility to the shoe outsole 100. The elliptical grooves 150 allow the forefoot region 130 of the shoe outsole 100 to flex in every direction, especially when the infant shoe 10 is rolled side-to-side along the transverse axis 104. Similarly, the substantially circular grooves 160 allow the heel region 140 to flex in every direction, especially when the infant shoe 10 is rolled side-to-side along the transverse axis 104. In some examples, the substantially circular grooves 160 in the heel region 140 are elliptical grooves. In some examples, the curved grooves 170 are substantially transverse to the longitudinal axis 102 of the shoe outsole 100. The curved grooves 170 may extend to both lateral side edges of the shoe outsole 100. The curved grooves 170 provide additional flexibility to the forefoot region 130 to accommodate forward flexion of the infant shoe 100 when rocked forward and backward.

The shoe upper 200 is stitched to the shoe outsole 100, in some implements, providing a substantially seamless transition between the shoe upper 200 and the shoe outsole 100. Using stitches to secure the shoe upper 200 to the shoe outsole 100, rather than cement, creates a smooth (e.g. non-bulky) and supple transition between the shoe upper 200 and the shoe outsole 100. Soft, premium leathers may be used in the construction of the shoe upper 200 to provide a flexible, soft, comfortable fitting infant shoe 10. Other materials may be used for the shoe upper 200 as well including textiles, non-woven materials, and any other suitable material.

Referring again to FIG. 1, the infant shoe 10 may include a foot bed 300 secured to the shoe outsole 100 inside the infant shoe 10. The foot bed 300 is compliant to conform to and exhibit the substantially arcuate shape of the shoe outsole 100, thereby forming a cradle for a baby's foot during use of the infant shoe 10. The foot bed 300 may be a foam sheet having thickness of between about 1 mm and about 8 mm (preferably about 5 mm) with a leather top covering adhered to the foam sheet.

The shoe outsole 100 is preferably constructed to be supple, flexible, and have a thickness of between about 3 mm and about 5 mm (preferably about 4 mm) to allow an infant to substantially feel the contours of a supporting surface through the shoe outsole 100 and the foot bed 300, while standing and/or walking on the supporting surface. The combination of using a relatively thin shoe outsole 100 having an arcuate shape and a supple shoe upper 200 provides an infant shoe 10 that is very flexible, pliable, compliant and that fits around the geometry of an infant's foot (e.g. which is generally rounded on the bottom), allowing tactile sensation of a supporting surface through the shoe 10. The ability to feel the supporting surface through the shoe 10 allows the infant to learn to use the sensory feedback from his/her feet to aid development of a proper gait (e.g. learning to walk).

A number of implementations have been described. Nevertheless, it will be understood that various modifications may be made without departing from the spirit and scope of the disclosure. Accordingly, other implementations are within the scope of the following claims.

What is claimed is:

1. An infant shoe comprising:

a shoe outsole having a forefoot region and an opposite heel region and defining a longitudinal axis and a transverse axis, the outsole defining a substantially arcuate shape along the longitudinal axis from a frontmost portion of the forefoot region to a rearmost portion of the heel region, and the outsole defining a substantially arcuate shape along the transverse axis from a first lateral side edge of the outsole to a second lateral side edge of the outsole; and a shoe upper secured to the shoe outsole, the shoe upper and the shoe outsole together defining curved side surfaces that extend within a substantially continuous curved plane such that the outsole and the shoe upper together form a substantially ellipsoid shape and allow an infant wearing the shoe to roll his or her foot to either side and forward and backward without rolling over a sharp edge, wherein a bottom surface of the shoe outsole defines a plurality of nested elliptical grooves substantially in the forefoot region, a plurality of substantially parallel curved grooves in the forefoot region, and a plurality of nested substantially circular grooves substantially in the heel region, each of the curved grooves extending substantially transverse to the longitudinal axis of the shoe outsole and intersecting at least one of the elliptical grooves, and at least some of the elliptical grooves intersecting at least some of the substantially circular grooves, and wherein the elliptical grooves allow the forefoot region of the shoe outsole to flex in every direction when the shoe is rolled side to side along the transverse axis, the substantially parallel grooves allow the forefoot region of the shoe outsole to flex longitudinally when the shoe is rocked forward and backward along the longitudinal axis, and the substantially circular grooves allow the heel region of the shoe outsole to flex in every direction when the shoe is rolled side to side along the transverse axis.

2. The infant shoe of claim 1, wherein the shoe upper has a top-line defining a foot access opening that extends between a toe cap portion of the shoe upper and a heel portion of the shoe upper.

3. The infant shoe of claim 2, wherein a front edge of a forward portion of the foot access opening defines a substantially curved shape.

4. The infant shoe of claim 2, further comprising a strap having first and second ends and positioned to extend across the foot access opening, the first end of the strap being secured to a first lateral side of the shoe upper, the second end of the strap being releasably secured to a second, opposite lateral side of the shoe upper.

5. The infant shoe of claim 1, further comprising a heel tab extending from an upper edge of a heel portion of the shoe upper, the heel tab being configured to move between a first position for use and a second position for storage, the heel tab extending upwardly and away from the shoe upper while in its first position, and the heel tab resting substantially against the heel portion of the shoe upper while in its second position.

6. The infant shoe of claim 1, wherein the shoe outsole comprises:

an outer member including an inner heel region; and an inner member located in the inner heel region and including a ground contacting surface, the inner member having a relatively higher durometer than the outer member, and the inner member being positioned and dimensioned to fit under a baby's heel during use of the infant shoe.

7. The infant shoe of claim 1, wherein the curved grooves extend to the first and second lateral side edges of the shoe outsole.

8. The infant shoe of claim 1, wherein the shoe upper is stitched to the shoe outsole, providing a substantially seamless transition between the shoe upper and the shoe outsole.

9. The infant shoe of claim 1, further comprising a foot bed disposed on the shoe outsole inside the infant shoe, the foot bed being compliant to conform to and exhibit the substantially arcuate shape of the shoe outsole, thereby forming a cradle for a baby's foot during use of the infant shoe.

* * * * *